United States Patent [19]

Meister

[11] 4,161,711

[45] Jul. 17, 1979

[54] CIRCUIT INTERRUPTING DEVICE

[75] Inventor: Otto Meister, Arlington Heights, Ill.

[73] Assignee: S & C Electric Company, Chicago, Ill.

[21] Appl. No.: 909,146

[22] Filed: May 24, 1978

[51] Int. Cl.[2] ..... H01H 85/38

[52] U.S. Cl. ..... 337/273; 200/150 R; 337/275; 337/277

[58] Field of Search ..... 337/273, 274, 275, 277, 337/148, 168, 173; 200/150 R, 61.08

[56] References Cited

U.S. PATENT DOCUMENTS

| | | | |
|---|---|---|---|
| 1,319,907 | 10/1919 | Schweitzer et al. | 337/277 |
| 2,353,528 | 7/1944 | Triplett | 337/275 |
| 2,571,735 | 10/1951 | Lindell | 337/275 |
| 4,034,175 | 7/1977 | Gratzmuller | 200/150 R |

*Primary Examiner*—R. L. Moses

*Attorney, Agent, or Firm*—John D. Kaufmann

[57] ABSTRACT

An improved circuit interrupting device extinguishes an arc by directing a dielectric fluid at the arc as it is elongated. Elongation is effected by relative movement apart of a pair of contacts between which the arc is established. A reservoir contains a piston which defines a first volume and a second volume. The fluid is held under pressure in the second volume. The reservoir directs the fluid in the second volume at the arc from a port normally closed by a diaphragm. One contact is normally mechanically attached to the diaphragm and is adjacent the other contact which is on the reservoir. Sudden expansion of the first volume, such as by the ignition of a power cartridge, forcefully moves the reservoir relative to the piston and away from the one contact. The seal is torn or cut open to permit the pressurized fluid to flow from the port simultaneously with the piston forcing the fluid from the second volume and the movement apart of the contacts.

60 Claims, 12 Drawing Figures

FIG. 4A
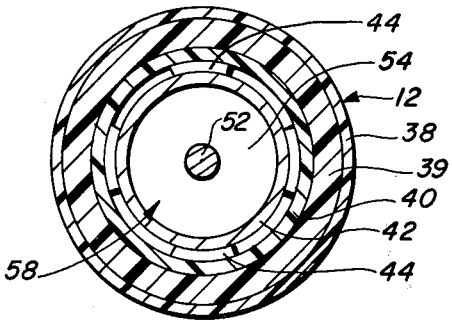
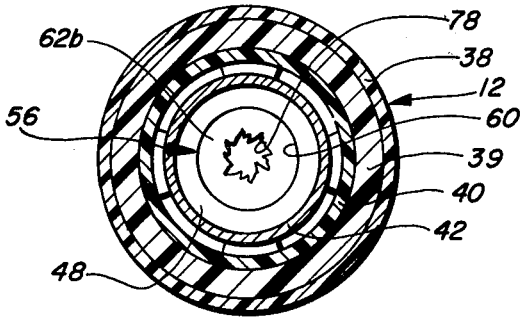
FIG. 4B
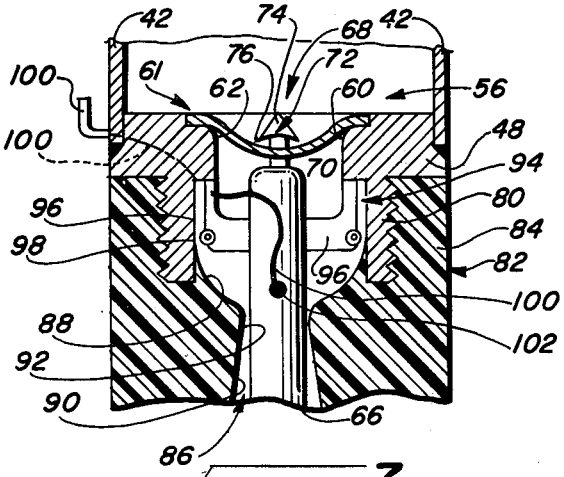
FIG. 7
FIG. 4
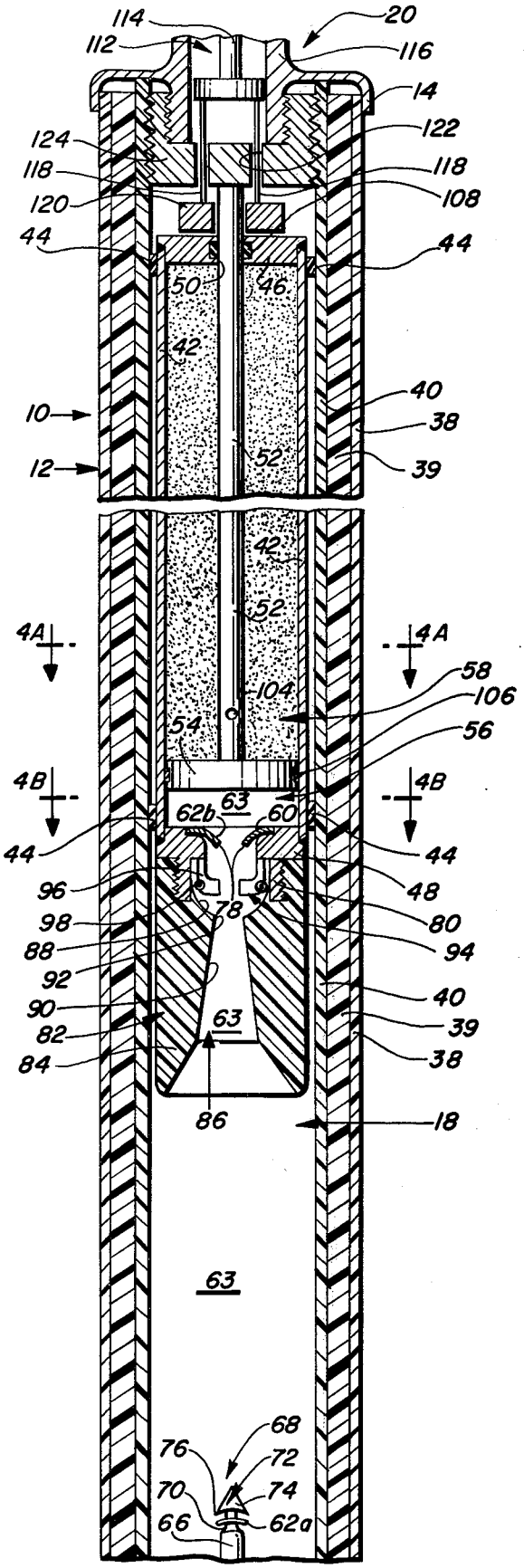

CIRCUIT INTERRUPTING DEVICE

BACKGROUND OF THE INVENTION

1. Field of the Invention

The present invention relates to an improved circuit interrupting device, and, more particularly, to an improved, high voltage, fuse-like circuit interrupting device which utilizes relatively movable contacts and pressurized dielectric fluid to extinguish an arc incident to circuit interruption.

2. Description of the Prior Art

Various alternating current circuit interrupting devices are well known, including fuses, circuit breakers, reclosers, circuit switchers, and the like. The present invention relates to fuses or fuse-like devices, as opposed to other types of interrupting devices.

In general, high voltage fuses utilizing a movable contact, often termed an "arcing rod", are well known. Typically, as the arcing rod moves, an arc is established between the arcing rod and a stationary contact. Such fuses normally contain a solid arc-extinguishing material often referred to as "ablative material") such as boric acid, cellulose "horn" fiber or the like. Interaction of the elongating arc with the solid arc-extinguishing material generates large quantities of high dielectric strength, arc-extinguishing gas which deionizes, cools and causes turbulence in the region occupied by the arc. These effects of the gas, in combination with the elongation of the arc as the arcing rod moves away from the stationary contact, extinguish the arc at a subsequent current zero. Typically, arcing rod movement is effected by a stored energy operator, such as a spring.

While prior art fuses of the type generally described above have been made to work well at 69 kV and below, when adapted for use at higher voltages, say 115 kV or higher, they become quite expensive and may operate inconsistently from fuse to fuse. Moreover, many prior art fuses are quite complicated and expensive, and many of the chemicals used as solid arc-extinguishing materials have recently become prohibitively priced or of uncertain availability.

Various prior art patents disclose fuses or fuse-like devices which are species of the fuses described above in general terms. This species of fuse utilizes movable contacts, stationary contacts, and various arc-extinguishing materials.

The following patents disclose fuses in which a pressurized fluid is used as an arc-extinguishing medium, usually in addition to an ablative arc-extinguishing material: Ackermann U.S. Pat. No. 3,285,838; Link U.S. Pat. No. 3,771,089; Rawlins U.S. Pat. No. 2,343,422; McCloud U.S. Pat. No. 3,032,630; Frink U.S. Pat. No. 3,268,690, and Triplett U.S. Pat. No. 2,319,277 (commonly assigned herewith). Although the fuses of these patents vary in their specific details of construction, they share many structural and functional features. Generally speaking, the fluid is retained in a reservoir by a massive stopper or plug. Connected in electrical series with the stopper is a fusible element, which is also connected to a stationary contact. A movable contact or arcing rod is prevented from moving away from the stationary contact by the presence of the fusible element. The arcing rod may be hollow and communicate with, or may constitute, the reservoir. Movement of the arcing rod is effected by a spring or by the jet action of the fluid escaping from the reservoir.

When an overcurrent melts the fusible element, the arcing rod is released for movement. Also, when the fusible element melts, an arc is established either between the stationary contact and the stopper, or in the vicinity of the stopper. The arc either burns a hole through the stopper or its heat melts the stopper, to release the fluid. Arc elongation, due to arcing rod movement, and fluid flow extinguish the arc.

The above-described devices have at least three inexpedient characteristics. First, the fusible elements and the stoppers are in electrical series and both must carry the normal, continuous current flowing through the devices. As a consequence, different stoppers (ie, different as to size, thickness and material), as well as different fusible elements, must be used at different current ratings of the devices. Accordingly, both the fusible element and the stopper determine the time-current characteristics of the fuses. Second, the stopper is burned through and melted only after the arc is established. The establishment of the arc is preceded by the melting of the fusible element. Thus, the resultant arc, and not the overcurrent per se, burns through and melts the stopper. As a consequence, the devices are somewhat slow to operate due to the time it takes for the sequential occurrence of the melting of the fusible element, the establishment of the arc, and the burning through by the arc of the stopper. Third, the stopper is rather massive (to resist both the melting effect of normal current and the force exerted by the pressurized fluid) and requires substantial energy to be melted.

Even more importantly, the repeatability and consistency (from sample-to-sample) and the predictability of operation of all of the above prior art devices are doubtful. In addition to the previously-noted deficiencies, when a fusible element is in electrical series with a stopper through which, an arc must burn a hole, the repeatable formation from sample-to-sample of a sufficiently large hole cannot be assured. Specifically, if a number of similar prior art devices were to be subjected to similar normal and fault conditions, arc-burned holes having various sizes, shapes and locations would be produced, due primarily to the evanescent nature of arcs and the inability to predict just where they may "root". Ackermann notes that "the opening [i.e., the hole] . . . may under certain conditions be too small to overcome by ['jet action'] the forces which hold the capsule [i.e., cartridge] . . . in place." Additionally, such variation in hole formation may be exacerbated by the variable heating effects on the stoppers caused by the variable normal currents they continuously carry. Moreover, the use of stoppers, through which the arc is expected to burn a hole, to carry normal current in series with a fusible element limits the choice of ampere ratings and time-current curves severely, leading, as noted by Ackermann, to the use of different arc-burned-through stoppers at different continuous and interrupting current ratings of the devices.

Commonly-assigned, co-pending, commonly-filed U.S. Pat. application Ser. No. 909,144, filed May 24, 1978 discloses a device which represents an improvement over the type of device described above. There, a thin fusible diaphragm reliably and predictably melts to permit pressurized dielectric fluid flow from a normally closed reservoir and to release an arcing rod, normally restrained by the diaphragm to the action of a spring. Most of the current flowing through the device is normally shunted away from the diaphragm by a fusible element, thus permitting the diaphragm to assume sufficient thinness to assure its reliable fusing. When the fusible element melts, all of the current flowing through the device is instantaneously directed through the diaphragm to melt it. The fluid flow and elongation of an arc struck between the moving arcing rod and a stationary contact extinguish the arc.

Five commonly-assigned U.S. Pat. Nos. 2,571,735 (to Lindell); 2,517,624 (to Baker); and 2,353,528; 2,319,277 (FIG. 12); and 2,319,276 (all to Triplett) relate to fuses in which a compressed dielectric fluid flows from a cartridge to aid in arc-extinguishment. Specifically, these patents disclose power fuses in which a spring-driven arcing rod moves away from a stationary contact following the melting of a fusible-element-strain-wire combination due to an overcurrent through the fuse. The movement of the arcing rod is effective to cause a pin or lance to move against the outside of, and to puncture, a seal closing the cartridge. An arc struck between the moving arcing rod and the stationary contact is extinguished by the combined action of the fluid from the cartridge, a gas evolved from a solid arc-extinguishing material with which the arc interacts, and arc elongation.

At first glance, the devices of these five patents might seem to eliminate one of the major disadvantages of the prior art devices utilizing a fusible stopper. Specifically, puncturing of a seal may appear to offer more reliable and predictable formation of a sufficiently large hole in the seal to ensure an instantaneous flow of fluid in large quantity. However, the entry of the pin into the seal from the outside thereof, in part blocks the hole so formed, interfering with fluid flow. Hollow pins used to alleviate this shortcoming also block the hole, there being limitations on the size of passageways in the pins due to the limited amount of space available in the fuse. Also, practical experience has shown that the pins—solid or hollow—often fail to puncture the seal due to the limited amount of driving force available from realistic springs.

In most of the prior art devices where pressurized dielectric gas or fluid has been used, the fluid is specifically effective only for the interruption of low fault currents. This is emphasized by the presence in the Ackermann, Baker, Frink, Lindell, Link, Rawlins and Triplett (all three) patents, of both contained pressurized fluid and a solid or ablative arc-extinguishing material, interaction of which with the arc produces (in addition to the fluid) arc-extinguishing gas which is primarily effective at high fault current levels.

Accordingly, an overall object of the present invention is to obviate the above-noted problems inherent in the above-noted prior art devices.

A further object of the present invention is the provision of a circuit interrupting device which (a) is simple, inexpensive to manufacture and predictably reliable in operation;

(b) works reliably above 69 kV;

(c) does not require an ablative arc-extinguishing material;

(d) does not rely on the burning or melting of a hole to release an arc-extinguishing fluid; and (e) avoids blockage of a hole formed in a seal by puncturing thereof.

Another object of the present invention is to provide an alternative to the improved device of U.S. Application, Ser. No. 909,144, filed May 24, 1978, which alternative does not involve the melting of a diaphragm.

In commonly-assigned, co-pending, co-filed U.S. Application Ser. No. 909,145, filed May 24, 1978, and incorporated by reference hereinto there is disclosed a fuse-like device which represents an improvement over, and an alternative to, the devices disclosed in the Lindell, Baker and Triplett patents. There, a diaphragm, normally closing a port of a pressurized fluid reservoir, is torn, ripped or cut open by relative movement between the reservoir and one contact which is mechanically attached to the diaphragm. Another contact on the reservoir moves away from the one contact simultaneously with the opening of the port to elongate an arc established between the contacts. Arc elongation and the fluid extinguish the arc. Relative movement between the one contact and both the reservoir and the other contact is effected by a piston-cylinder which is operated by a high energy pressure source such as a power cartridge.

This device of the above-identified co-pending application represents an improvement over prior devices due to the reliable formation of a large hole in the diaphragm which permits high velocity fluid flow. Moreover, rapid contact separation—and, therefore, arc elongation—is assured. Additionally, the device is versatile: it may operate in response to a fault condition or in response to any other selected condition even when the current through the device is within acceptable limits. Nevertheless, this device relies on the pressure of the fluid in the reservoir to effect flow thereof from the port. It is desirable to provide a device which does not rely entirely on the fluid's pressure to effect the flow thereof. The provision of such an alternative or improved device is, accordingly, a still further object of the present invention.

SUMMARY OF THE INVENTION

With these and other objects in view, the present invention contemplates an improved circuit interrupting device of the type having a reservoir of pressurized dielectric fluid. A port in the reservoir directs the fluid at an arc which is established between, and elongated by, a pair of relatively movable contacts as they move apart. A diaphragm which normally closes the port is torn or cut to open the port in response to relative movement apart of the contacts. Also, the fluid is forced from the port at a rate higher than that achievable by the fluid pressure alone in response to relative movement apart of the contacts. Facilities are provided for relatively moving the contacts apart.

In preferred embodiments, a tearing or cutting force is applied to the diaphragm in the same direction in which the fluid flows from the port. One contact may be on the reservoir and the diaphragm may be torn by a mechanical attachment between the other contact and the diaphragm, whereby relative contact movement apart effects relative movement apart of the other contact and the diaphragm. The contacts may be moved apart by a piston-cylinder which is operated by ignition of a power cartridge. The fluid may be forced from the port by the same piston-cylinder.

As used herein, the words "tear" or "rip" connote the tearing, ripping, cutting, slicing, incising, rupturing or the like of the diaphragm. As noted, a tearing or ripping force is applied to the diaphragm in the same general direction as taken by the fluid flowing from the port. The tearing or ripping force may be effected by the diaphragm being pulled in this specified direction against facilities outside the reservoir which cut the diaphragm. The tearing or ripping force may also be effected by facilities within the reservoir which are pulled against the diaphragm in this specified direction until the diaphragm tears or rips. Lastly, the tearing or ripping force may be applied simply by pulling on the diaphragm in the specified direction until it tears or rips.

"Tearing" or "ripping" of the diaphragm also contemplates removal of some, all or none of the diaphragm. Specifically, application of the tearing or ripping force may remove a piece of, or the entire, diaphragm. Such removal is in the direction taken by the fluid flowing from the port. If any of the diaphragm remains in the port, it is moved out of the fluid flow by the fluid flowing therepast, by the tearing or ripping force, or by both of these. Alternatively, the tearing or ripping force may merely slice through the diaphragm to form one or more openings therethrough from which the fluid may flow. Portions of the diaphragm between the openings are moved out of the fluid flow by the fluid flowing therepast, by the tearing or ripping force, or by both of these.

This manner of tearing or ripping the diaphragm and of moving any remaining portions thereof out of the fluid flow, avoids blockage of the port to maximize the effects of the fluid in extinguishing the arc.

BRIEF DESCRIPTION OF THE DRAWINGS

FIG. 4 is a view similar to FIG. 3 showing the device of the present invention following operation thereof;

FIGS. 4A and 4B are sectional views taken along lines 4A—4A and 4B—4B of FIG. 4;

FIG. 7 is a magnified view of a portion of FIGS. 4 and 5 which better illustrates a portion of an interrupting unit thereof;

DETAILED DESCRIPTION

Figure 1:
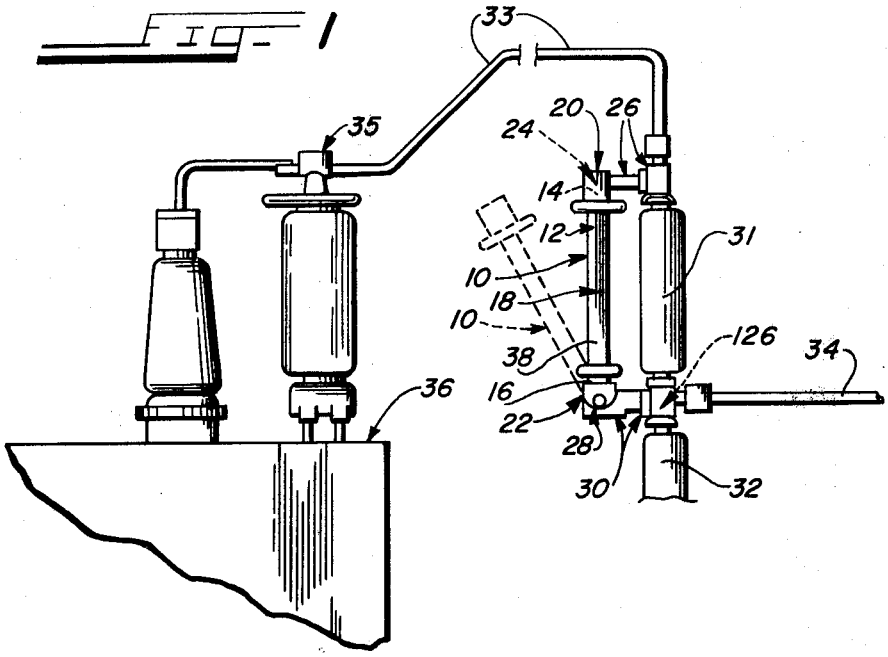
FIG. 1 is a general view of a circuit interrupting device according to the present invention, the device being used to protect a transformer and being vertically mounted for dropout operation.
Figure 2:
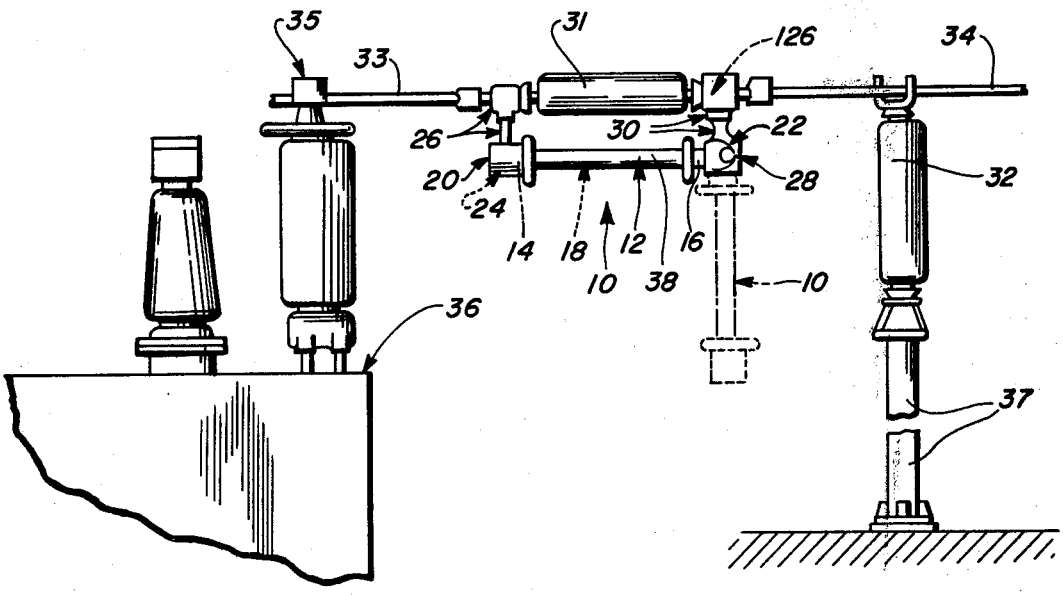
FIG. 2 is another general view of a circuit interrupting device according to the present invention, the device being horizontally mounted for dropdown operation.
Figure 3:
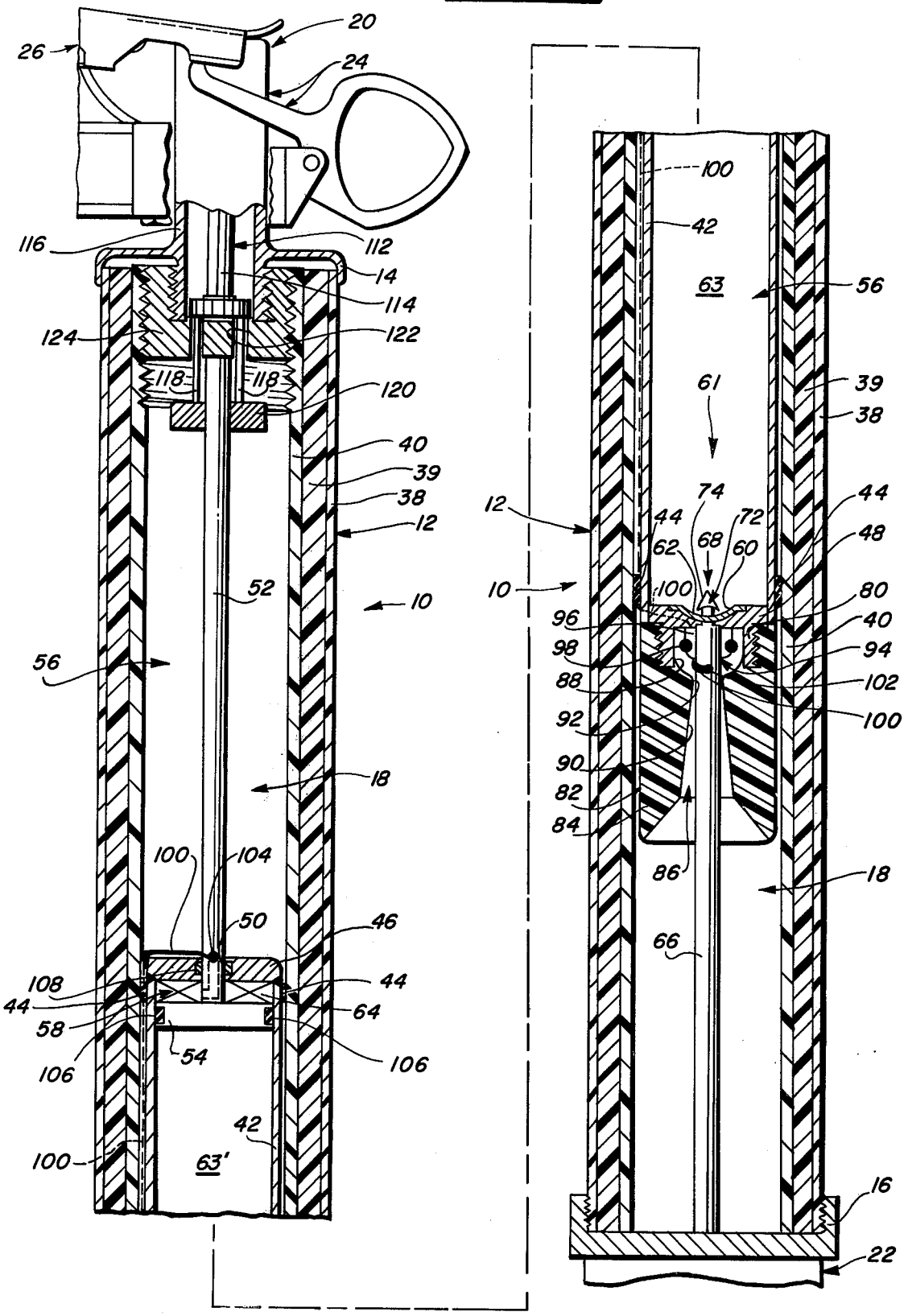
FIG. 3 is a partially sectioned, side view of a single-gap circuit interrupting device usable as shown in FIGS. 1 and 2.

General—FIGS. 1-3

The circuit interrupting device 10 in accordance with the principles of the present invention is a fuse-like device which can perform a circuit interrupting function. The device 10 is generally depicted in FIG. 1 in a so-called vertical dropout configuration, wherein following operation of the device 10 to interrupt a circuit, the device 10 drops out from its normal vertical position, as shown in solid lines, to a position rotated therefrom as shown by the dotted lines. In FIG. 2, a similar device 10 is shown in a so-called horizontal, dropdown configuration wherein following operation, the device 10 drops down to the position shown in dotted lines. It is not necessary that the device 10 be used in either configuration, but may be used in any orientation, in either a non-dropout or a nondropdown configuration.

Referring now to FIGS. 1, 2 and 3, the device 10 includes an outer insulative housing 12 carrying a pair of circuit connectable terminals, such as metallic, conductive end ferrules 14 and 16, on opposed ends thereof. The ferrules 14 and 16 need not have any particular configuration and are variously depicted in the Figures. An interrupting unit 18 contained within the housing 12 performs the circuit interrupting function described in more detail below.

The end ferrules 14 and 16 may respectively mount end fittings 20 and 22. One of the end fittings 20 may include a latch 24 which normally engages a first mounting or latch mechanism 26 for maintaining the device 10 in its normal vertical (FIG. 1) or horizontal (FIG. 2) orientation. The other end fitting 22 may include a hinge 28 which is engaged by a second mounting or hinge mechanism 30. The cooperation of the hinge 28 and the hinge mechanism 30 permits rotation of the interrupting device 10 when the latch 24 is operated so as to release the latch mechanism 26. The end fittings 20 and 22, the latch 24, the latch mechanism 26, the hinge 28, and the hinge mechanism 30 may take any convenient form known to those skilled in the art and form no crucial part of the present invention. Moreover, as is well known, the latch 24 may be operated to permit rotation of the device 10 either by operation of the device 10 or by manipulation of a pull ring on the end fitting 20 with a hookstick (not shown). The end fittings 20 and 22 are selectively attachable to opposed circuit points represented in FIGS. 1 and 2 by the latch mechanism 26 and the hinge mechanism 30, to which circuit points the interrupting device 10 is connectable. As noted, the device 10 need not be used in a dropout or dropdown configuration, but may be used in a non-dropout or non-dropdown mode. In this latter event, the housing 12 may include a series of leakage-distance increasing skirts (not shown), as is well known.

The latch mechanism 26 and the hinge mechanism 30 may be maintained apart in a fixed insulated relationship by one or more insulators 31. The insulator 31 and the mechanisms 26 and 30 may, in turn, be supported by an insulator stack 32 or the like (FIG. 1), with respective buses 33 and 34 being connected to the mechanisms 26 and 30 in any appropriate manner. The bus 33 may be connected to a bushing 35 of a transformer 36 protected by the device 10. The bus 34 is connected to a power source (not shown). As shown in FIG. 2, the device 10 may also be mounted directly in the buses 33 and 34 feeding the transformer 36, in which case the insulator stack 32 may support one bus 34 with the other bus 33 being supported by the bushing 35. Thus, the device 10 may be either bus-mounted (FIG. 2) or may be more conventionally mounted (FIG. 1). In either event, the insulator stack 32 may be mounted by a ground-supported column 32 or the like. If the device 10 is used in a non-dropout or non-dropdown fashion, it may be directly connected into the buses 33 and 34 by any known mounting facility.

Referring to FIG. 3, the insulative housing 12 may comprise an outer layer or skin 38 of a weather-resistant, insulative material including any well known plastic or polymer. Inside the skin 38 may be a generally cylindrical dielectric body 39 made of a high dielectric strength, low electrical permittivity material, which may be a foam for grading electrical stress on the exterior of the housing 12 following operation of the device 10. Yet another insulative cylinder 40 may be within the dielectric body 39. The insulative cylinder 40, which may be glass-reinforced epoxy, adds internal structural strength and integrity to the device 10 especially where the body 39 is foam. The end ferrules 14 and 16 are mounted in any convenient manner to the housing 12 so that they close and seal the open ends thereof.

Interrupting Unit 18—First Embodiment—FIGS. 3, 4, 4A, 4B and 7

FIGS. 3 and 4 depict a first embodiment of the circuit interrupting device 10 of the present invention in which the interrupting unit 18 opens a single gap. Within the housing 12 is a fluid reservoir 42, which may be a container, cylinder, canister, cartridge or the like. The reservoir 42 is preferably made of a conductive material, but may also be made of a non-conductor, such as a ceramic, with an end-to-end conductive path formed thereon. The reservoir 42 is mounted for movement within the housing 12 generally along the major axes of the housing 12 and the reservoir 42. To aid in such movement, mounted between to the outside of the reservoir 42 and the inside of the cylinder 40 may be a plurality of low friction guide members 44 in the form of individual blocks or rings. The guide members 44 provide a low friction track for the reservoir 42. The ends of the reservoir 42 are closed by wall members 46 and 48 to be described in detail below. The wall members 46 and 48 may be attached to, or formed integrally with, the reservoir 42.

The wall 46 contains a central aperture 50 which slidably receives a conductive, stationary piston rod 52. The piston rod 52 is mounted by facilities to be described in detail below to the end ferrule 14. Attached to the free end of the piston rod 52 and residing within the reservoir 42 is a piston 54. Both the piston rod 52 and the piston 54 are preferably made of a conductive material.

The piston 54 complementarily engages and is slidable along the interior wall of the reservoir 42. In the normal position of the reservoir 42 as shown in FIG. 3, the reservoir 42, the wall members 46 and 48, and the piston 54 define a large first volume 56 and a small second volume 58. Movement of the reservoir 42 relative to the stationary piston 54 varies the volumes 56 and 58.

Formed in the wall member 48 is a port 60 communicating with the first volume 56. The port 60 is normally closed by a diaphragm facility 61, which includes a relatively thin diaphragm, seal, membrane, or the like 62, preferably made of a thin conductive disk which is appropriately attached in any convenient fashion such as soldering or brazing to the wall member 48. The diaphragm 62 has sufficient structural strength to resist bursting by the pressure, and prevents the escape from the port 60, of a pressurized dielectric fluid 63, which may be sulphurhexafluoride, or the like. The diaphragm 62 also has the property of being rather easily torn, cut, sliced or ripped by appropriate facilities, described below. As used herein, "pressurized" means that the pressure of the fluid 63 in the reservoir 42 is higher than the pressure within the remainder of the housing 12 before the device 10 operates.

At first glance, the properties of the diaphragm 62—resistant to bursting by the pressurized fluid and ability to be easily cut—may seem antithetical. However, as discussed below, facilities which cut or tear the diaphragm 62 are capable of generating such high forces in a short time, that the cutting or tearing of a robust diaphragm 62 creates little difficulty. Moreover, the diaphragm may have a uniform thickness or a variable thickness, and in either event may have a pattern of decreased thickness formed therein along which tearing is effected.

The second volume 58 defined between the piston 54 and the wall 46 normally contains a power cartridge 64 or the like. Ignition of the power cartridge 64 causes the rapid evolution of high pressure gases which generate force between the piston 54 and the wall member 46 to cause upward movement of the reservoir 42. Assuming that the diaphragm 62 is not closing the port 60, as will hereinafter be described, such movement of the reservoir 42 relative to the piston 54 causes an increase in the second volume 58 and a decrease in the first volume 56. The decrease in the first volume 56 forces the already pressurized dielectric fluid 63 from the first volume 56 and out of the port 60 at high rate, higher, in fact, than the rate achievable by the fluid pressure alone.

A stationary contact 66 is provided at the lower end of the housing 12. This stationary contact 66 is referred to herein as an arcing rod, but differs from the usual arcing rod found in typical fuses in that it does not move. The arcing rod 66 is made of a conductive metal, preferably copper or copper alloy, and may be elongated along the central axis of the housing 12, although it may have different or shorter configurations. The arcing rod 66 is fixed in any convenient manner such as direct mechanical attachment to the end ferrule 16 and is prevented from movement thereby. Facilities 68 normally mechanically interconnect the arcing rod 66 to the diaphragm 62 for a purpose to be described subsequently.

Referring to FIGS. 3 and 7, the facilities 68 may comprise a simple mechanical attachment between the arcing rod 66 and the diaphragm 62. As disclosed in commonly-assigned, co-filed, co-pending U.S. patent application Ser. No. 909,145, filed May 24, 1978, and incorporated by reference hereinto this mechanical attachment may take the form of a necked-down portion 70 on the arcing rod 66 which passes through the diaphragm 62 and is headed in the form of a button (not shown) against the diaphragm 62 within the first volume 56. The necked-down portion 70 may be integral with or attached to the arcing rod 66, and may be a conductor, an insulator or an insulated conductor. To prevent leakage of the dielectric fluid 63 through the diaphragm 62, the necked-down portion 70 and the diaphragm 62 may be brazed or soldered together in a gas-tight manner. The necked-down portion 70 may carry at its end within the first volume 56 a cutting tip 72 rather than the button (not shown). Again, as disclosed in the commonly-assigned, co-filed, co-pending U.S. patent application Ser. No. 909,145, filed May 24, 1978, the cutting tip 72 may include a frusto-conical member 74 having a cutting edge 76 or a plurality of cutting edges, formed thereon.

The cutting edges 76 are so configured that movement of the reservoir 42 away from the arcing rod 66 causes the edges 76 to come into contact with and tear, cut or puncture the diaphragm 62, permitting free movement of the reservoir 42 away from the arcing rod 66. The cutting edges 76 may be replaced by, or used with, knife edges (not shown) formed along the surface of the cutting tip 72 which slice through the diaphragm at various locations as the reservoir 42 moves away from the arcing rod 66. Such cutting or slicing may directly form a hole 78 (FIG. 4) through the diaphragm 62 permitting the escape of the fluid 63 from the reservoir 42, the arcing rod 66 carrying a fragment 62*a* of the diaphragm 62. Alternatively, the cutting edges 76 or the knife edges may indirectly result in formation of the hole 78. Specifically, the edges may cut or slice through the diaphragm 62 at various locations, the hole 78 being formed by the rapid flow of the fluid 63 which outwardly deforms the now cut or sliced diaphragm 62. For this reason, the depiction of the diaphragm 62*a* on the arcing rod 66, and the depiction of the remains 62*b* of the diaphragm 62 at the port 60, are exemplary only.

The cutting tip 72 may be configured so as to ensure that the hole 78 is quite large. Specifically, the cutting edges 76 or the knife edges (not shown) may define a star pattern. When these edges cut or slice through the diaphragm 62, a plurality of separated, petal-like portions of the diaphragm 62 remain. These petal-like portions are then deformed outwardly by the fluid 63 flowing therepast, producing the enlarged hole 78. A similar effect may be achieved by a pre-scored star-shaped pattern in the diaphragm 62.

The diaphragm 62 may be flat or may be concave where it faces the cutting edges 76 as shown in FIGS. 3 and 7. The diaphragm 62 may also be convex. Concavity or convexity permit some initial movement of the reservoir 42 away from the arcing rod 66 due to a slight deformation or an eversion of the diaphragm 62. Slight deformation or eversion of the diaphragm 62 permits some limited relative movement between the cutting edges 76 or the knife edges (not shown) and the diaphragm 62 until the edges cut or slice the diaphragm 62.

Figure 6:
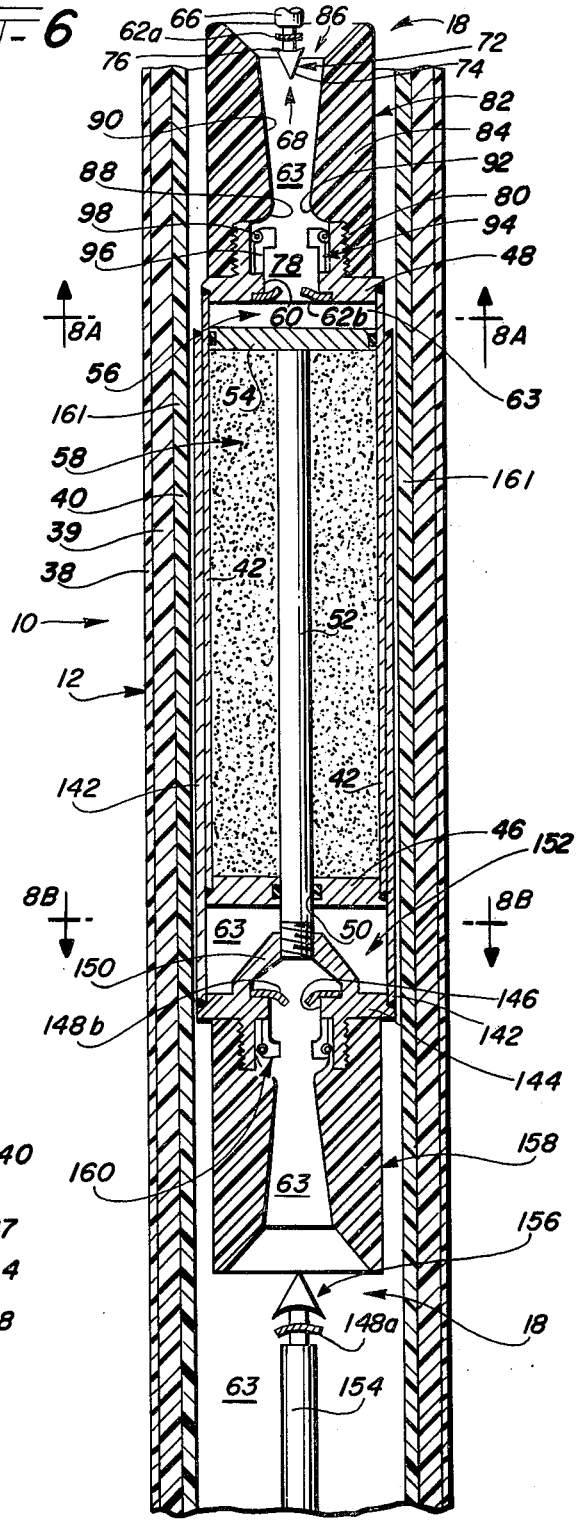
FIG. 6 is a view similar to FIG. 5 showing the device of the present invention following operation thereof.

As shown in FIG. 6 of the above-noted, co-filed application, the wall 48 may include one or more conical protrusions (not shown) surrounding the port 60 and the arcing rod 66. Tips on the protrusions, which may be formed as the cutting tip of a can opener, are adjacent, but spaced from, the diaphragm 62. When the reservoir 42 moves away from the arcing rod 66, these tips cut into the diaphragm 62 as the button (not shown) or the cutting tip 72 pulls the diaphragm 62 thereagainst. The cutting tips on the protrusions (not shown) may be structurally and functionally similar to the cutting edges 76 to facilitate formation of the hole 78.

Regardless of the nature of the facility 68 which mechanically interconnects the arcing rod 66 to the diaphragm 62, such facility 68 is so selected that relative movement of the reservoir 42 away from the stationary arcing rod 66 causes this facility 68 to tear, cut, or rip some or all of the diaphragm 62 to form the hole 78 therethrough. When the hole 78 is so formed, the pressurized dielectric fluid 63 within the reservoir 42 may escape through the port 60. The diaphragm 62 is made sufficiently thin, or may be pre-scored, so that when the reservoir 42 and the arcing rod 66 move apart, the diaphragm 62 tears or rips to form the hole 78, the arcing rod 66 carrying a fragment of the diaphragm 62. The device 10, so far generally described, operates in the following manner. Referring to FIGS. 3 and 4, normally the device 10 conducts current between the ferrules 14 and 16 through a conductive path which includes the piston rod 52, the reservoir 42, and the arcing rod 66. If the power cartridge 64 is ignited, the reservoir 42 moves upwardly. Upward movement of the reservoir 42 effects two simultaneous ends. First, relative movement between the diaphragm 62 and the arcing rod 66 causes the facility 68 to tear, cut or rip the diaphragm 62, forming the hole 78 (FIG. 4) and opening the port 60 to permit the escape from the first volume 56 of the pressurized dielectric fluid 63. Second, the piston 54 forces the already-pressurized dielectric fluid 63 from the first volume 56 and out the port 60 at an even greater velocity and in even greater quantity than is achievable by the pressure of the dielectric fluid 63 alone. The continued expansion of the gases evolved from ignition of the power cartridge 64 continues to move the reservoir 42 upwardly and continues to force the pressurized dielectric fluid 63 from the first volume 56.

The formation of the hole 78 in the diaphragm 62 by the facility 68 is followed by the breaking of the electrical continuity between the arcing rod 66 and the reservoir 42 as described in detail below. As a consequence, an arc is established between these two members 42 and 66. Continued movement of the reservoir 42 elongates the arc. Simultaneously with this elongation, the dielectric fluid 63 cools, deionizes and makes turbulent the region of the arc. The combined effects of arc elongation and the dielectric fluid 63 ultimately extinguish the arc.

The above description embodies the essence of the principles utilized in the device 10 of the present invention. The structure described below represents preferred forms taken by various portions of the device 10 so far described.

The wall 48 may contain a circular flange 80 exterior of the first volume 56. Mounted to the flange 80 for movement with the reservoir 42 may be a nozzle 82 which comprises a dielectric body 84 of a temperature-resistant material such as polytetrafluoroethylene having a central passageway 86 therethrough. The passageway 86 surrounds and communicates with the port 60. The passageway 86 may define chambers 88 and 90 interconnected by a restriction or throat 92. Fluid flowing from the port 60 enters the first chamber 88 and reaches sonic or near sonic velocity at the throat 92. This achieves the end of directing the dielectric fluid 63 by the nozzle 82 at the arc at a velocity sufficient to ensure arc extinguishment. The use of such a nozzle 82 is well known in the art. When the reservoir 42 moves, the passageway 86 moves axially over the arcing rod 66.

Preferably, the hole 78 formed in the diaphragm 62 is larger than the passageway 86 at the throat 92. This ensures that the fluid 63 attains sonic velocity only at the throat 92 and is otherwise uninhibited in its flow from the port 60 until it reaches the throat 92. Clearly, the size of the cutting tip 72 or of the button (not shown); the size and location of the cutting edges 76, the knife edges (not shown) or the tips on the conical protrusion (not shown); the size of the port 60; and the area of the diaphragm 62 may all be selected to ensure this relationship. Specifically, although the cutting tip 72 cannot be larger than the throat 92, a hole 78 larger than both the throat 92 and the cutting tip 72 may be easily produced, for example, by utilizing an appropriate pattern in the diaphragm 62 or by judicious placement of the knife edges on the cutting tip 72. It may be preferred that the diameters of the arcing rod 66 and the throat 92 are substantially equal so that the arcing rod 66 effectively closes the chamber 88 until the throat 92 moves therepast. This has the effect of preventing any substantial flow of the fluid 63 from the passageway 86 until a rather large separation or gap between the arcing rod 66 and the reservoir 42 is present. Until such separation occurs, the chamber 88 acts as a plenum or accumulator for the fluid 63.

Also surrounding the port 60 and attached to, or formed integrally with, the wall member 48 may be a tulip contact 94 which provides a normal electrical connection between the arcing rod 66 and the reservoir 42. The tulip contact 94 may include a plurality of contact fingers 96 held in frictional sliding engagement with the arcing rod 66 by an encircling garter spring 98. The fluid 63 flowing from the port 60 easily flows through spaces between the fingers 96. In a preferred form of the present invention, the tulip contact 94 comprises a movable contact of the device 10 and it is preferably between this movable contact 94 and some portion of the arcing rod 66 that the arc is established. This occurs due to the fact that the last electrically connected members to separate upon movement of the reservoir 42 are the arcing rod 66 and the tulip contact 94. However, it is not necessary that the arc be so established. The tulip contact 94 need not be used, and entire reliance for electrical continuity may be placed on the mechanical and electrical connection between the arcing rod 66 and the diaphragm 62, which is in turn electrically and mechanically connected to the reservoir 42. In this latter event, the arc is established between the arcing rod 66 and some portion of the reservoir 42 or the wall 48 adjacent the port 60. Accordingly, the term "movable contact" encompasses either the tulip contact 94, some portion of the reservoir 42 or of the wall 48 adjacent the port 60, or a separate contact on the reservoir 42 in the event it is nonconductive.

The use of the sliding contact 94 is preferred because it avoids reliance on the diaphragm 62 for carrying the normal current through the device 10. The $I^2R$ heating effects of such normal current on the diaphragm 62 may have an unpredictable effect on its ability to be torn or cut as well as on its ability to resist bursting due to the pressure of the fluid 63. Thus, the use of the tulip contact 94, in effect, prevents the diaphragm 62 from carrying more than a minor portion of the normal current flowing through the device 10 and permits the diaphragm to be torn or cut in a predictable manner.

To ensure that the diaphragm 62 carries little if any current, the necked-down portion 70 and the cutting tip 72 may be made of an insulative material. Should usual insulative materials prove not sufficiently strong to tear or cut the diaphragm 62, the necked-down portion 70 and the cutting tip 72 may comprise a metal covered with an insulative oxide formed by anodization or the like. Electrically insulating the arcing rod 66 from the diaphragm 62, and the action of the tulip contact 94, forces all current normally flowing in the device 10 to follow a path 66,94,48,42 and prevents any current flow in the diaphragm 62.

One end of the arc established between the "moving contact"—the tulip contact 94, or a portion of the reservoir 42 or the wall 48 adjacent the port 60—and the arcing rod 66 may terminate on the cutting tip 72, on the necked-down portion 70 or on the arcing rod 66 immediately adjacent the necked-down portion 70. Where the cutting tip 72 and the necked-down portion 70 are insulative, the arc terminates on the arcing rod 66 itself; if these elements 70 and 72 are covered with oxide, the arc may burn therethrough and terminated thereon shortly after its establishment. Thus, the term "stationary contact" refers to the cutting tip 72, the necked-down portion 70 or the arcing rod 66 itself.

Relative movement apart of the contacts elongates the arc in the gap therebetween. The term "gap" refers to the physical separation, and the distance between the contacts.

The power cartridge 64 may assume any convenient configuration. As is well known, the power cartridge 64 may include a so-called pressure cartridge which is capable of generating energy for any system requiring work. Such cartridges 64 usually include a hermetically sealed unit containing smokeless powder or the like and a fusible bridge wire, the heating or fusing of which ignites the powder. Power cartridges are typically ignitable by low currents flowing through the bridge wire typically in the 5 ampere range. Such cartridges are available from Quantic Industries Inc. of San Carlos, Calif., and Holex, Inc. of Hollister, Calif. U.S. Pat. Nos. 3,851,219 and 3,400,301; and French Pat. No. 262,393 describe the general use of such cartridges in fuses or fuse-like devices. The following articles provide additional background on the use of power cartridges: "A Current Limiting Device for Service Voltages Up to 34.5 kV" by Keders and Liebold, paper A76436-6, presented at the IEEE PES Summer Meeting, Portland, Oreg., July 18–23, 1976; "Limiting Fault Currents Between Private and Public Networks," by M. C. Blythe in *Electrical Review* (U.K.), Oct. 5, 1973; and "Fault Levels Too High?" leaflet number 1197/6E of Calor-Emag Electrizitats - Aktiengessellschaft, Ratingen, West Germany.

Although the power cartridge 94 is preferred, because it permits the generation of high energy in a short time, other facilities (not shown) for expanding the second volume 58 may be used. For example, a hydraulic, or other high-fluid-pressure-generating system may be located in, or connected to, the second volume 58 so as to effect its rapid expansion and the concomitant rapid movement of the reservoir 42 with the movable contact thereon. The only constraints on whatever energy generator is chosen are that is must generate:

(a) sufficient force and energy to positively form the hole 78; and (b) sufficient force and energy to rapidly relatively move the movable contact on the reservoir 42 and the arcing rod 66 after formation of the hole 78.

Present at the sliding interfaces of the aperture 50 in the wall 46 and the piston rod 52, and of the piston 54 and the reservoir 42, may be sealing structure, such as O-rings or the like, which prevent the ignition products of the power cartridge 64 from contaminating both the fluid 63 in the first volume 56 and the interior of the housing 12. These ignition products may include conductive moieties, such as metal ions, which could degrade or supersede the arc-extinguishing properties of the fluid 63.

The power cartridge 64 may be ignited via a pair of insulated conductive leads 100 which are connected to the bridge wire of the power cartridge 64. These leads 100 may enter the second volume 58 in any convenient manner which does not inhibit, or interfere with, the movement of the reservoir 42. Depending on the form of entry of the leads 100 through the reservoir 42 into the second volume 58, any convenient shearing or cutting structure (not shown) may, if necessary, be associated with the inside wall of the insulative cylinder 40 for cutting or severing these leads 100 immediately upon initial movement of the reservoir 42. While the leads 100 may be routed within the device 10 in a wide variety of ways, one way of routing them is depicted in the Figures. Specifically, the leads 100 may enter from the exterior of the device 10 through the end ferrule 16 and pass through the arcing rod 66 which may be hollowed out for that purpose. The leads 100 may then pass from the arcing rod 66 through an aperture 102, passing then through the circular flange 80 and from there to a space defined between the reservoir 42 and the cylinder 40. From there the leads 100 pass longitudinally of the reservoir 42 where they enter an aperture 104 in the piston rod 52, passing from such aperture 104 through a hollowed-out portion of the piston rod 52 immediately behind the piston 54. Within the second volume 58 the leads 100 pass through another aperture (not shown) in the piston rod 52 for connection to the power cartridge 64. The leads 100 may be severed at several points. First, the leads may be severed by an edge of the wall 46 where they pass thereover as shown in FIG. 3. Second, the leads 100 may be severed or broken at or near the hole 102 by the relative movement between the reservoir 42 and the arcing rod 66. Third, the leads 100 may be severed by the relative movement of the aperture 104 and the aperture 50.

Electrical continuity between the piston rod 52 and the cylinder 42 may be assured in a wide variety of known ways. For example, a sliding contact 106 may be contained in the outer periphery of the piston 54 for electrically contacting the inside wall of the reservoir 42. The electrical continuity provided by the sliding contacts 106 is in addition to the sliding electrical contact between the piston rod 52 and the walls of the aperture 50 formed in the wall member 46. Sliding contacts 108 similar to the sliding contacts 106 may also be held by the walls of the aperture 50. Alternatively, a tulip contact (not shown) similar to the tulip contact 94 may be formed integrally with or mounted to either side of the wall member 46 for sliding electrical engagement of the piston rod 52.

Any one of a wide variety of means may be provided for preventing movement of the movable contact—which may comprise either the tulip contact 94 or a portion of the reservoir 42 or of the wall 48 immediately adjacent the port 60, as described above—back toward the arcing rod 66 following operation of the device 10. A simple way of preventing such movement is the provision of a decreased diameter (not shown) at the lower end of the reservoir 42. Moreover, one or more leaf spring-like members (not shown) may be mounted to the inner wall of the reservoir 42. The decreased diameter or the leaf spring-like members may be easily formed so that the piston 54 is wedged thereagainst following upward movement of the reservoir. This wedging prevents return downward movement of the reservoir 42.

As noted earlier, the device 10 may be used in a non-dropout or a non-dropdown configuration. In that event, following the above-described operation of the device 10, some or all of the device 10 may be replaced. The device 10 remains in the solid line orientations shown in FIGS. 1 and 2 following operation. Should dropout or dropdown action be desired, a dropout mechanism 112 may be provided. The dropout mechanism 112 includes a pin 114 slidably mounted within a flange 116 attached to or formed integrally with the end ferrule 14. Upward movement of the pin 114 as seen in FIG. 3 operates the latch 24 or the latch mechanism 26 to cause disengagement therebetween and to permit the device 10 to pivot on its hinge 28 in the hinge mechanism 30 into the dropout or dropdown position illustrated by dotted lines in FIGS. 1 and 2. The pin 114 is connected by one or more connecting rods 118 to a circular collar 120 surrounding the piston rod 52 and slidable thereover. The connecting rods 118 pass through appropriate apertures 122 formed in a conductive member 124 which is formed integrally with or attached to the end ferrule 14 and which may mount the piston rod 52. The member 124 may also be attached by any convenient means, as by threading, to the inside surface of the cylinder 40 and to the outside of the flange 116. As shown in FIG. 4, following ignition of the power cartridge 64, the wall 46 of the reservoir 42 moves upwardly. Ultimately, the wall member 46 contacts the collar 120 forcing the collar 120, the connecting rods 118, and the pin 114 upwardly. Continued movement of the reservoir 42 moves the pin 114 sufficiently upwardly to operate the latch 24 or the latch mechanism 26 to permit dropout or dropdown action of the device 10 (FIG. 4). The pin 114, the connecting rods 118, and the collar 120 may be maintained in their normal downward positions depicted in FIG. 3 by a spring or other convenient biasing member (not shown) in the flange 116.

A portion of the interrupting unit 18 following operation of the device 10 is depicted in FIG. 4. The hole 78 has been cut or torn away in the diaphragm 62 by the facilities 68 on the arcing rod 66. The wall member 46 has moved the pin 114 upwardly to operate the latch or latch mechanism 24 or 26. The piston 54 and the reservoir 42 are held in the position shown in FIG. 4 by the decreased diameter of the reservoir 42 or by the leaf spring-like members (not shown).

A sensing and triggering device 126 is provided for igniting the power cartridge 64 by transmission of an appropriate signal on the leads 100. This device 126 may be located in any convenient location such as within the device 10, within the latch mechanism 26, or within the hinge mechanism 30. The sensing and triggering device 126 is generally shown within the hinge mechanism 30 in FIGS. 1 and 2.

A current path for the circuit 33 and 34 is normally provided by the device 10 as follows: the ferrule 16, the arcing rod 66, the tulip contact 94, the wall 48, the reservoir 42, the wall 46, the piston rod 52, the member 124, and the ferrule 14. When the power cartridge 64 is ignited by the device 126, the diaphragm 62 is torn and the fluid 63 flows from the port 60 due to its own pressure and the action of the piston 54 and the moving reservoir 42. As the arcing rod 66 disengages the tulip contact 94 an arc is established therebetween, because of the high voltage impressed on the circuit 33 and 34. The arc is elongated by the parting movement between the arcing rod 66 and the tulip contact 94. This elongation and the fluid 63 extinguish the arc to interrupt the circuit 33 and 34.

The sensing and triggering device 126 may take any convenient form and is preferably an electronic overcurrent-sensing and control circuit which is either selected or adjustable to have a predetermined time-current characteristic. In this event, the device 126 may sense current levels in the circuit 33 and 34 to automatically ignite the power cartridge 64 when the current level is within a predetermined abnormal range. Alternatively, the device 126 may ignite the power cartridge 64 in response to some condition other than the current level in the circuit 33 and 34. One such condition may be the pressure within the transformer 36. Thus, the device 10 may operate to protect the circuit 33 and 34 and the transformer 36 from overcurrents or fault conditions; it may also be used to interrupt the circuit 33 and 34 for reasons other than overcurrents or faults, including merely the desire to open the circuit 33 and 34 for any reason. The latter type of operation of the device 10, which does not depend on an overcurrent or fault, may be termed "shunt tripping", and can occur even though the current in the circuit 33 and 34 is within acceptable limits. The device 126 may, therefore, in conjunction with the device 10, provide either circuit protection, shunt tripping or both.

The use of the device 126 is not mandatory. Other facilities may be used. For example, a sensor (not shown) such as a current transformer, or a direct connection (not shown) to the circuit 33 and 34 may be located in one of the mountings 26 or 30 to generate an output proportional or equal to the current level in the circuit 33 and 34. This output may be fed to the power cartridge 64, ignition of which is normally prevented by a typical fusible element (not shown) shunting the power cartridge 64. When the current level in the circuit 33 and 34 gets sufficiently high, the fusible element melts to direct the full output to the power cartridge 64 for ignition thereof. The sensing and triggering device 126 may be contained as a plug-in or selectively removable module within either of the mountings 26 or 30.

The sensing and triggering device 126, where present, is used functionally to:

(1) sense overcurrents in the circuit 33 and 34 or to sense some other conditions. Such sensing may be effected in part by any convenient sensor in any known fashion, for example, by a current transformer in the circuit 33 and 34, or by a pressure sensor in the transformer; and (2) transmit an ignition signal to the power cartridge 64.

Where overcurrent or fault sensing is involved, both functions (1) and (2) may be performed in a manner similar to the more usual form of a fuse. Additionally, only a certain range of current flowing for a certain time in the circuit 33 and 34 may effect ignition of the power cartridge 64 along the lines of time-current-characteristic determining devices used in circuit breakers. Any other intelligence or processing device between any type of sensor and the power cartridge 64 is within the skill of the art and forms no part of the present invention.

The device 10 is a so-called one-shot device. After the device 10 has interrupted the circuit 33 and 34, the entire device 10 may be replaced with a new device 10 for subsequent protection of the circuit 33 and 34 and of the transformer 36. Alternatively, the device 10 may be constructed so that only certain parts need to be replaced following operation. Specifically, one or both of the ferrules 14 and 16 may be attached to the housing 12 so as to permit selective removal thereof. Following such removal, either the insulative cylinder 40, or the body 39, or both may be removed carrying therewith the reservoir 42, the nozzle 82, the piston 54, and the piston rod 52. Because of the stationary connection between the piston rod 52 and the ferrule 14, those two elements may be threaded together to permit selective attachment therebetween. Following removal of either the insulative cylinder 40 or the body 39, a new cylinder 40 or body 39 is then inserted into the housing 12 carrying therewith the removed elements as well as a new power cartridge 64. Such insertion of the new cylinder 40 or body 39 may be accompanied by a threading re-engagement between the new piston rod 52 and the ferrule 14 and re-attachment of the removed ferrule 14 or 16.

Interrupting Unit 18—Second Embodiment—FIGS. 5, 6, 7, 8, 8A and 8B

Figure 5:
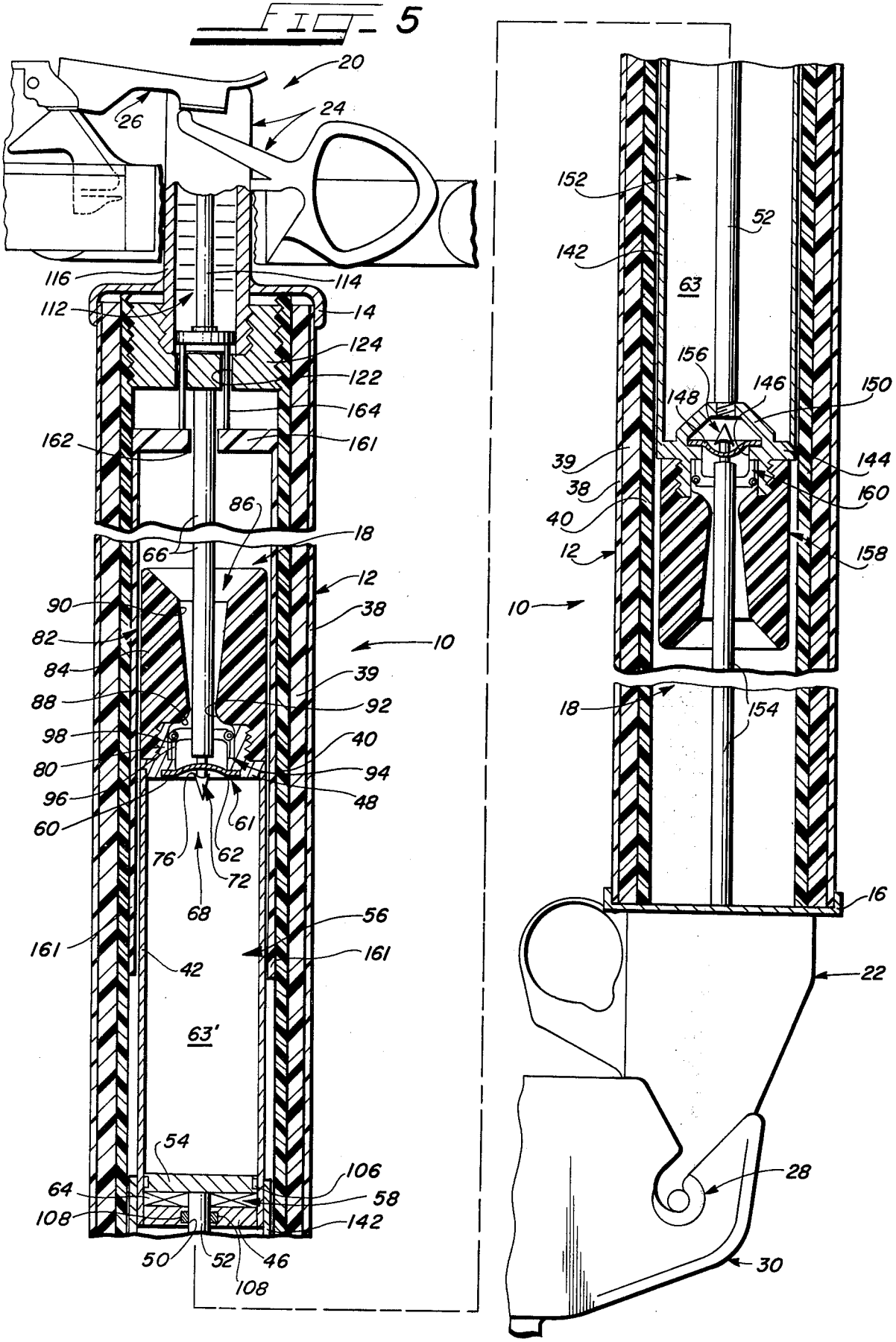
FIG. 5 is a partially sectioned, side view of a two-gap circuit interrupting device according to the principles of the present invention and usable as shown in FIGS. 1 and 2.

The device 10 may have a two-gap configuration in contradistinction to the single-gap embodiment depicted in FIGS. 3 and 4. Referring to FIGS. 5 and 6, a two-gap device 10 is seen to have many components in common with the device 10 depicted in FIGS. 3 and 4, and the same reference numerals are used therefor.

The upper end of the device 10 of FIGS. 5 and 6 is similar to a mirror image of the device 10 shown in FIGS. 3 and 4. Specifically, a movable reservoir 42 is mounted for sliding movement within the housing 12. The reservoir 42 includes a port 60 normally closed by a diaphragm 62, and mounts a nozzle 82 and a sliding contact 94. Facilities 68 mechanically attach a stationary arcing rod 66 to the diaphragm 62. The reservoir 42 also contains a conformal piston 54 attached to the end of a piston rod 52 which passes through an aperture 50 in a wall member 46. The arcing rod 66 is stationarily attached to the member 124 near the ferrule 14, rather than to the end ferrule 16 as in FIGS. 3 and 4.

Figure 8A:
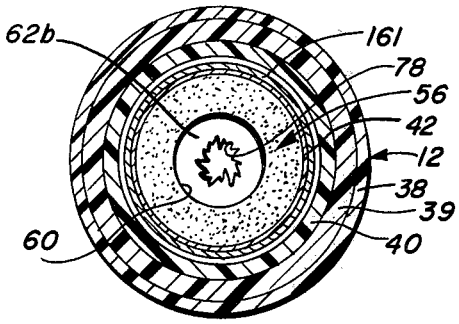
FIGS. 8A and 8B are sectional views of FIG. 6 taken along lines 8A—8A and 8B—8B thereof.
Figure 8B:
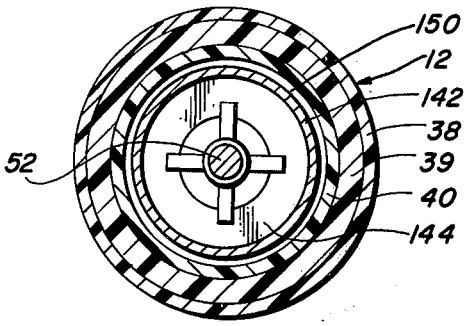
Figure 8:
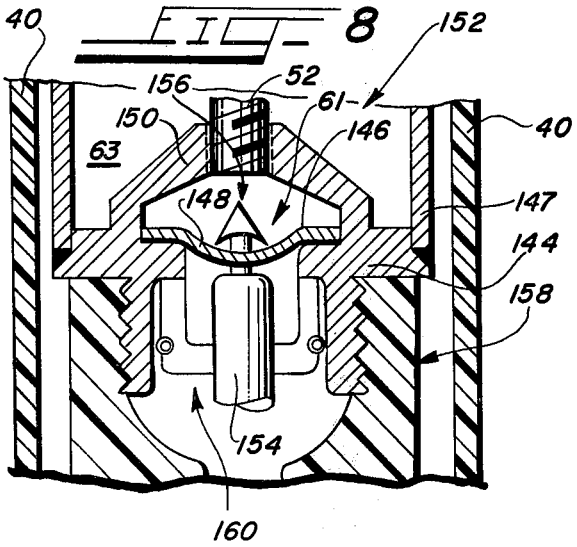
FIG. 8 is a magnified view of a portion of FIG. 5 which better illustrates a portion of an interrupting unit thereof.

Telescoped with the reservoir 42 is a second reservoir 142 mounted for sliding movement within the housing 12. Referring to FIGS. 6 and 8, one end of the reservoir 142 is closed by a wall member 144 which is similar to the wall member 48 in that it contains a port 146 (similar to the port 60) normally closed by a diaphragm 148 (similar to the diaphragm 62). The wall member 144 differs from the wall member 48 in that it contains a bridge member 150 attached to the wall member 144 or formed integrally therewith. The bridge member 150 is connected in any convenient manner to the piston rod 52 which mounts the piston 54. The other end of the second reservoir 142 is closed by the movable wall member 46 of the first reservoir 42 which acts as a piston in the second reservoir 142. The exterior of the first reservoir 42 sealingly engages the interior of the second reservoir 142. First volumes 56 and 152 of both reservoirs 42 and 142 are filled with the dielectric fluid 63. A power cartridge 64 occupies a second volume 58 which may be said to be common to both reservoirs 42 and 142 and which resides between the two pistons 54 and 46.

Ignition of the power cartridge 64 moves the piston 54 upwardly and the wall member or piston 46 of the first reservoir 42 downwardly. Upward movement of the piston 54 moves the second reservoir 142 upwardly via the movable piston rod 52 and its connection to the bridge member 150. Downward movement of the wall member or piston 46 moves the first reservoir 42 downwardly. Thus ignition of the power cartridge 64 moves the two pistons 54 and 46 in opposite directions and moves the ports 60 and 146 of both reservoirs 42 and 142 toward each other, as seen in FIG. 6.

The second reservoir 142 is associated with a second stationary contact or arcing rod 154 which is stationarily connected to the end ferrule 16, but is otherwise similar to the arcing rod 66. The stationary contact or arcing rod 154 is mechanically attached to the diaphragm 148 by facilities 156 similar to, and performing the same function as, the facilities 68 associated with the first reservoir 42. The second reservoir 142 also includes a nozzle 158 and a sliding contact 160 which are respectively the same as or similar to the nozzle 82 and the sliding contact 94 and perform similar functions.

The interfaces between the following elements are electrically conductive, as necessary, to insure electrical continuity between the reservoirs 42 and 142: the piston 54 and the reservoir 42; the wall of the aperture 50 and the movable piston rod 52; and the reservoirs 42 and 142. These interfaces may include any convenient sliding contact structure, similar to elements 106 and 108 in FIG. 3. Moreover, the first two interfaces may include any convenient seal structure (not shown) to ensure that the ignition products of the power cartridge 64 do not escape the second volume 58.

In the normal condition of the device 10, current in the circuit 33 and 34 flows through the following path: the ferrule 16, the arcing rod 154, the tulip contact 160, the wall 144, the reservoir 142 (or the piston rod 52, the wall 46 and the piston 54), the reservoir 42, the wall 48, the arcing rod 66, the member 124 and the ferrule 14.

Ignition of the power cartridge 64 which initiates conjoint movement of the reservoirs 42 and 142 effects simultaneous tearing of both diaphragms 62 and 148 and the simultaneous issuance from both now open ports 60 and 146 of the dielectric fluid 63. Simultaneously, a pair of arcs are struck between each arcing rod 66 and 154 and their movable contacts, whether such be the sliding contacts 94 and 160 or some portion of the reservoirs 42 and 142 adjacent the ports 60 and 146. The two arcs so struck are ultimately extinguished by their mutual elongation and the action of the dielectric fluid 63 flowing from the ports 60 and 146.

Because the movement of the two reservoirs 42 and 142 is away from the respective end ferrules 14 and 16, the achievement of a dropout function of the device 10 shown in FIGS. 5 and 6 is a bit more complicated than was the case in FIGS. 3 and 4. Any convenient way of achieving such dropout function may be utilized, a preferred form being depicted in FIGS. 5 and 6. Specifically, a slidable, insulative tube 161 engaging the inner surface of the cylinder 40 is included at the upper end of the device 10. The insulative tube 161 includes an aperture 162 through which the arcing rod 66 passes. The tube 161 terminates at a point which in the normal condition of the device 10 is near the port 60 in the reservoir 42. The other end of the tube 161 either abuts or carries one or more connecting rods 164 which slidingly pass through the apertures 122 in the member 124, both of which are similar to the corresponding element described with reference to FIGS. 3 and 4. The connecting rods 164 abut or are carried by the lower end of a pin 114 which is structurally and functionally similar to the pin 114 described with reference to FIGS. 3 and 4. Following ignition of the power cartridge 64 sufficient upward movement of the reservoir 142 ultimately brings its terminal into contact with the end of the insulative tube 161. Continued upward movement of the second reservoir 142 moves the tube 161 upwardly to move the connecting rods 164 and the pin 114 upwardly to achieve the above-described dropout or dropdown function of the device 10.

CONCLUSION

Various changes may be made in the above-described two embodiments of the present invention without departing from the scope thereof. It may be seen that the present invention is an improvement over prior art devices which involve the puncturing of a seal or the like by a pin to achieve a flow of a dielectric fluid. Specifically, in the present invention due to relative movement away from each other of the arcing rod 66 or 154 and the diaphragm 62 or 148, formation of the holes 78 involves no blockage thereof. This is in contradistinction to the prior art devices in which a pin or piercing member enters a seal and either partially or completely blocks the hole so formed.

What is claimed is:

1. An improved circuit interrupting device of the type having a reservoir of pressurized dielectric fluid with a port for directing the fluid at an arc, and a pair of relatively movable contacts which receive respective ends of, and elongate, the arc as they move apart, wherein the improvement comprises:

a diaphragm normally closing the port;

means for tearing the diaphragm to open the port in response to movement of the contacts apart;

means responsive to movement of the contacts apart for forcing the pressurized fluid from the port at a rate higher than that achievable by the fluid pressure alone; and means for relatively moving the contacts apart.

2. A device according to claim 1, wherein the tearing means tears the diaphragm by applying thereto a tearing force in the same direction in which the fluid flows from the port.

3. A device according to claim 2, wherein one contact is on the reservoir.

4. A device according to claim 3, wherein the tearing means comprises a mechanical attachment between the diaphragm and the other contact, contact movement apart effecting movement apart of the other contact and the diaphragm to tear the diaphragm.

5. A device according to claim 4, wherein the moving means comprises a piston in the reservoir, relative movement between the piston and the reservoir relatively moving the contacts; and power cartridge means for relatively moving the piston and the reservoir upon ignition thereof.

6. A device according to claim 4, wherein the forcing means comprises a piston in the reservoir, relative movement between the piston and the reservoir forcing the fluid from the port; and power cartridge means for relatively moving the piston and the reservoir upon ignition thereof.

7. A device according to claim 4, wherein the moving means and the forcing means comprise a piston in the reservoir, relative movement between the piston and the reservoir relatively moving the contacts and forcing the fluid from the port; and power cartridge means for relatively moving the piston and the reservoir upon ignition thereof.

8. A device according to claim 4, wherein the moving means comprises a piston in the reservoir, relative movement between the piston and the reservoir relatively moving the contacts.

9. A device according to claim 8, wherein the moving means further comprises force generating means for relatively moving the piston and the reservoir.

10. A device according to claim 2, wherein the reservoir is movable, and one contact is on the reservoir.

11. A device according to claim 10, wherein the tearing means comprises
a mechanical attachment between the diaphragm and the other contact, contact movement apart effecting movement apart of the other contact and the diaphragm to tear the diaphragm.

12. A device according to claim 11, wherein the moving means comprises
a piston in the reservoir, relative movement between the piston and the reservoir relatively moving the contacts; and
power cartridge means for relatively moving the piston and the reservoir upon ignition thereof.

13. A device according to claim 11, wherein the forcing means comprises
a piston in the reservoir, relative movement between the piston and the reservoir forcing the fluid from the port; and
power cartridge means for relatively moving the piston and the reservoir upon ignition thereof.

14. A device according to claim 11, wherein the moving means and the forcing means comprise
a piston in the reservoir, relative movement between the piston and the reservoir relatively moving the contacts and forcing the fluid from the port; and
power cartridge means for relatively moving the piston and the reservoir upon ignition thereof.

15. A device according to claim 1, wherein the moving means comprises
force generating means.

16. A device according to claim 15, wherein the force generating means comprises
a power cartridge.

17. A device according to claim 16, wherein the moving means further comprises
a piston in the reservoir, the piston and the reservoir being relatively moved by ignition of the power cartridge.

18. A device according to claim 1, wherein the tearing means comprises
a mechanical connection between the diaphragm and one contact, contact movement apart effecting movement apart of the one contact and the diaphragm to tear the diaphragm.

19. A device according to claim 1, wherein the tearing means, the forcing means and the moving means comprise
a piston in the reservoir.

20. A device according to claim 19, wherein the tearing means, the forcing means and the moving means further comprise
force generating means for relatively moving the piston and the reservoir.

21. A device according to claim 20, wherein the force generating means comprises
a power cartridge.

22. An improved circuit interrupting device of the type having a reservoir of pressurized dielectric fluid with a port for directing the fluid at an arc, and a pair of relatively movable contacts which receive respective ends of, and elongate, the arc as they move apart, wherein the improvement comprises:
means for normally closing the port;
means for opening the port in response to movement of the contacts apart;
means responsive to movement of the contacts apart for forcing the pressurized fluid from the port at a rate higher than that achievable by the fluid pressure alone; and
means for relatively moving the contacts apart.

23. An improved circuit interrupting device of the type having a reservoir of pressurized dielectric fluid with a port for directing the fluid at an arc, and a pair of relatively movable contacts which receive respective ends of, and elongate, the arc as they move apart, wherein the improvement comprises:
the reservoir being movable;
a diaphragm normally closing the port;
means for tearing the diaphragm to open the port in response to movement of the reservoir away from one of the contacts;
means for moving the other contact and the reservoir away from the one contact; and
means responsive to movement of the reservoir away from the one contact for forcing the pressurized fluid from the port at a rate higher than that achievable by the fluid pressure alone.

24. An improved device according to claim 23, wherein
movement of the other contact and of the reservoir is simultaneous and concurrent.

25. An improved device according to claim 24, wherein
the other contact is on the reservoir.

26. An improved device according to claim 25, wherein
the reservoir and the diaphragm are electrically conductive, and which further comprises
means for normally electrically connecting the one contact to the reservoir.

27. An improved device according to claim 26, wherein
the connecting means and the tearing means comprise
a mechanical connection between the one contact and the diaphragm.

28. An improved device according to claim 27, wherein
the other contact comprises
a portion of the reservoir adjacent the port.

29. An improved device according to claim 26, wherein
the connecting means comprises
sliding contact means on the reservoir for slidably, electrically contacting the one contact until a predetermined amount of movement of the other contact has occurred; and
the tearing means comprises
a mechanical connection between the one contact and the diaphragm.

30. An improved device according to claim 29, wherein
the other contact comprises
a portion of the sliding contact means.

31. An improved device according to claim 23, wherein
the tearing means comprises
a mechanical connection between the diaphragm and the one contact.

32. An improved device according to claim 31, wherein
the moving means comprises
a power cartridge, ignition of which moves the other contact and the reservoir.

33. An improved device according to claim 32, wherein the moving means further comprises
a stationary piston within the reservoir defining therewithin a first variable volume and a second variable volume, the first volume containing the fluid and communicating with the port, the power cartridge being in the second volume.

34. An improved device according to claim 33, wherein
the other contact is on the reservoir adjacent the port and the mechanical connection, and wherein
ignition of the power cartridge moves the reservoir relative to the piston to decrease the first volume so that the fluid is forced from the port and to move the reservoir and the other contact away from the one contact so that the mechanical connection tears the diaphragm.

35. An improved device according to claim 31, wherein
the moving means comprises
a piston within the reservoir.

36. An improved device according to claim 35, wherein
the reservoir and the piston are relatively movable.

37. An improved device according to claim 36, wherein
the piston is stationary.

38. An improved device according to claim 36, wherein
the piston is movable.

39. A device according to claim 23, which further comprises
third and fourth relatively movable contacts which receive respective ends of, and elongate, a second arc as they move apart;
a second movable reservoir of pressurized dielectric fluid with a second port for directing the fluid at the second arc;
a second diaphragm normally closing the second port;
second means for tearing the second diaphragm to open the second port in response to the second reservoir moving away from the third contact; and
second means for moving the fourth contact and the second reservoir away from the third contact.

40. A device according to claim 39, wherein
both tearing means comprise respective mechanical connections between the diaphragms and the one contact and the third contact.

41. A device according to claim 39, wherein
the first moving means comprises
first piston means in the first reservoir, and
means for conjointly moving the first piston and the second reservoir; and
the second moving means comprises
second piston means in the second reservoir, and
means for conjointly moving the second piston and the first reservoir.

42. A device according to claim 41, wherein
the first and the second moving means further comprise
power cartridge means for conjointly moving the pistons upon ignition thereof.

43. A device according to claim 42, wherein
movement of the piston means is oppositely directed away from each other;
the other contact and the fourth contact are on their respective reservoirs; and
movement of the reservoirs is such that the other contact and the fourth contact move toward each other therewith.

44. A circuit interrupting device, which comprises
an insulative housing having opposed circuit-connectable terminals closing the ends thereof;
a stationary contact within the housing and electrically connected to one of the terminals;
a movable conductive reservoir within the housing, the reservoir having a port and being filled with a pressurized dielectric fluid;
first means connected between the stationary contact and the port
for sealing the port against the escape of fluid from the cylinder when the cylinder is in a first normal position,
for opening the port to permit fluid escape therefrom when the cylinder moves out of the first position away from the stationary contact,
for electrically connecting the stationary contact to the cylinder in the first position, and
for receiving one end of an arc established between the first means and the stationary contact after the cylinder moves out of the first position away from the stationary contact;
a stationary piston within the cylinder, the piston being electrically connected to the other terminal, movement of the cylinder away from the stationary contact forcing the fluid from the port; and
means for moving the cylinder out of the first position and away from the stationary contact.

45. An improved circuit interrupting device of the type having a reservoir of pressurized dielectric fluid with a port from which the fluid flows; and a pair of contacts relatively movable apart and between which an arc is struck, the fluid being directed from the port at the arc, wherein the improvement comprises
a diaphragm normally closing the port; and
means for
(i) moving the contacts apart,
(ii) tearing the diaphragm to open the port, and
(iii) forcing the fluid from the reservoir and out of the port at a rate in excess of that achievable by the pressure of the fluid alone.

46. A device according to claim 45, wherein
the diaphragm is torn by a tearing force applied in the direction of fluid flow from the port.

47. A device according to claim 45, wherein
the diaphragm is torn by a tearing force directed away from the reservoir.

48. A device according to claim 45, wherein
the moving, tearing, and forcing means comprises
a piston in the reservoir, the piston and the reservoir being relatively movable, relative movement between the piston and the reservoir forcing the fluid from the port.

49. A device according to claim 48, wherein
the reservoir is movable,
one of the contacts moves with the reservoir, and
the piston and the other contact are stationary, movement of the reservoir away from the stationary contact also moving the stationary contact and the diaphragm away therefrom.

50. A device according to claim 49, wherein
the moving, tearing and forcing means further comprises
a mechanical connection between the diaphragm and the stationary contact, movement of the diaphragm away from the stationary contact tearing the diaphragm via the mechanical connection.

51. A device according to claim 50, wherein the moving tearing and forcing means further comprises reaction means acting between the piston and the reservoir for moving the reservoir away from the stationary contact.

52. A device according to claim 51, wherein the reaction means comprises a power cartridge, the ignition of which moves the reservoir relative to the piston.

53. A device according to claim 45, wherein the moving, tearing and forcing means comprises a power cartridge.

54. A device according to claim 53, wherein the moving, tearing and forcing means further comprises a piston within the reservoir, the piston and the reservoir being relatively movable by the ignition of the power cartridge acting between the piston and the reservoir, relative movement between the piston and the reservoir forcing the fluid from the port.

55. A device according to claim 54, wherein the reservoir is movable, one of the contacts moves with the reservoir, and the piston and the other contact are stationary, movement of the reservoir away from the stationary contact also moving the one contact and the diaphragm away therefrom.

56. A device according to claim 55, wherein the moving, tearing and forcing means further comprises a mechanical connection between the diaphragm and the stationary contact, movement of the diaphragm away from the stationary contact tearing the diaphragm via the mechanical connection.

57. A device according to claim 55, wherein the reservoir is movable, one of the contacts moves with the reservoir;

the other contact is stationary, movement of the reservoir away from the stationary contact also moving the one contact and the diaphragm away therefrom; and wherein the moving, tearing and forcing means comprises a mechanical connection between the diaphragm and the stationary contact, movement of the diaphragm away from the stationary contact tearing the diaphragm via the mechanical connection.

58. An improved circuit interrupting device of the type having a reservoir of pressurized dielectric fluid with a port for directing the fluid at an arc, and a pair of relatively movable contacts which receive respective ends of, and elongate, the arc as they move apart, wherein the improvement comprises:

means for normally closing the port;

means responsive to the contacts parting for removing the closing means from the port in the same direction in which the fluid flows from the port;

means responsive to the contacts parting for forcing the pressurized fluid from the port at a rate higher than that achievable by the fluid pressure alone; and means for relatively moving the contacts apart.

59. A device according to claim 1, which further includes means for preventing any substantial current flow in the diaphragm.

60. An improved circuit interrupting device of the type having a reservoir of pressurized dielectric fluid with a port for directing the fluid at an arc, and a pair of relatively movable contacts which receive respective ends of, and elongate, the arc as they move apart, wherein the improvement comprises:

a diaphragm normally closing the port;

means for tearing the diaphragm to open the port as the contacts move apart; and means for forcing the pressurized fluid from the port at a rate higher than that achievable by the fluid pressure alone as the contacts move apart.

* * * * *